United States Patent [19]

Wennerstrom

[11] 4,076,454

[45] Feb. 28, 1978

[54] VORTEX GENERATORS IN AXIAL FLOW COMPRESSOR

[75] Inventor: Arthur J. Wennerstrom, Dayton, Ohio

[73] Assignee: The United States of America as represented by the Secretary of the Air Force, Washington, D.C.

[21] Appl. No.: 699,929

[22] Filed: Jun. 25, 1976

[51] Int. Cl.[2] ..... F01D 1/02

[52] U.S. Cl. ..... 415/208; 60/39.72 R; 415/210; 415/217; 415/DIG. 1

[58] Field of Search ..... 415/207, 208, 209, DIG. 1, 415/216, 217, 218; 60/39.72 R

[56] References Cited

U.S. PATENT DOCUMENTS

| | | | |
|---|---|---|---|
| 2,558,816 | 7/1951 | Bruynes | 60/39.72 R |
| 2,603,949 | 7/1952 | Brown | 60/39.72 R |
| 2,607,191 | 8/1952 | Lee | 160/39.72 R |
| 2,650,752 | 9/1953 | Hoadley | 415/207 |
| 2,844,001 | 7/1958 | Alford | 415/216 |
| 3,879,939 | 4/1975 | Markowski | 415/217 |
| 3,921,391 | 11/1975 | Hall et al. | 60/39.72 R |

*Primary Examiner*—C. J. Husar

*Attorney, Agent, or Firm*—Joseph E. Rusz; Richard J. Killoren

[57] ABSTRACT

An axial flow compressor having a vortex generator system positioned upstream of a rotor with the height of the blades of the vortex generator system being greater then the running clearance of the rotor.

The vortex generator system has at least three blades for each of the rotor blades and is spaced from the rotor blades such that the leading edge of the rotor is a distance from the vortex generator system greater then ten times the height of the vortex generator blades and the trailing edge of the rotor blades is a distance from the leading edge of the vortex generator system less then eighty times the height of the vortex generator blades. The spacing between the vortex generator blades is at least four times the height of the vortex generator blades.

1 Claim, 4 Drawing Figures

VORTEX GENERATORS IN AXIAL FLOW COMPRESSOR

RIGHTS OF THE GOVERNMENT

The invention described herein may be manufactured and used by or for the Government of the United States for all governmental purposes without the payment of any royalty.

BACKGROUND OF THE INVENTION

Vortex generators have been used in many applications for improving flow characteristics of fluids over fluid confining surfaces. The patent to Hoadley, U.S. Pat. No. 2,650,752, shows several applications for such vortex generators.

In prior art systems wherein vortex generators have been used in compressors, the height of the vortex generator blades have been related to the thickness of the boundary layer.

BRIEF SUMMARY OF THE INVENTION

According to this invention, a vortex generator system, having a plurality of blades mounted on a support ring, is positioned upstream of the rotor. The height of the blades is greater than the running clearance of the rotor blades. The leading edge of the rotor is spaced from the vortex generators a distance greater than ten times the height of the vortex generator blades. The trailing edge of the rotor is positioned a distance from the leading edge of the vortex generator blades less than 80 times the height of the vortex generator blades. The vortex generator has at least three blades for each of the blades of the rotor.

IN THE DRAWINGS

DETAILED DESCRIPTION OF THE INVENTION

Figure 3:
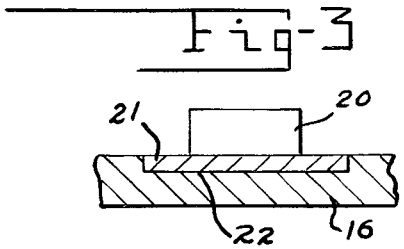
FIG. 3 is an enlarged sectional view of the device of FIG. 2 along the line 3—3.
Figure 1:
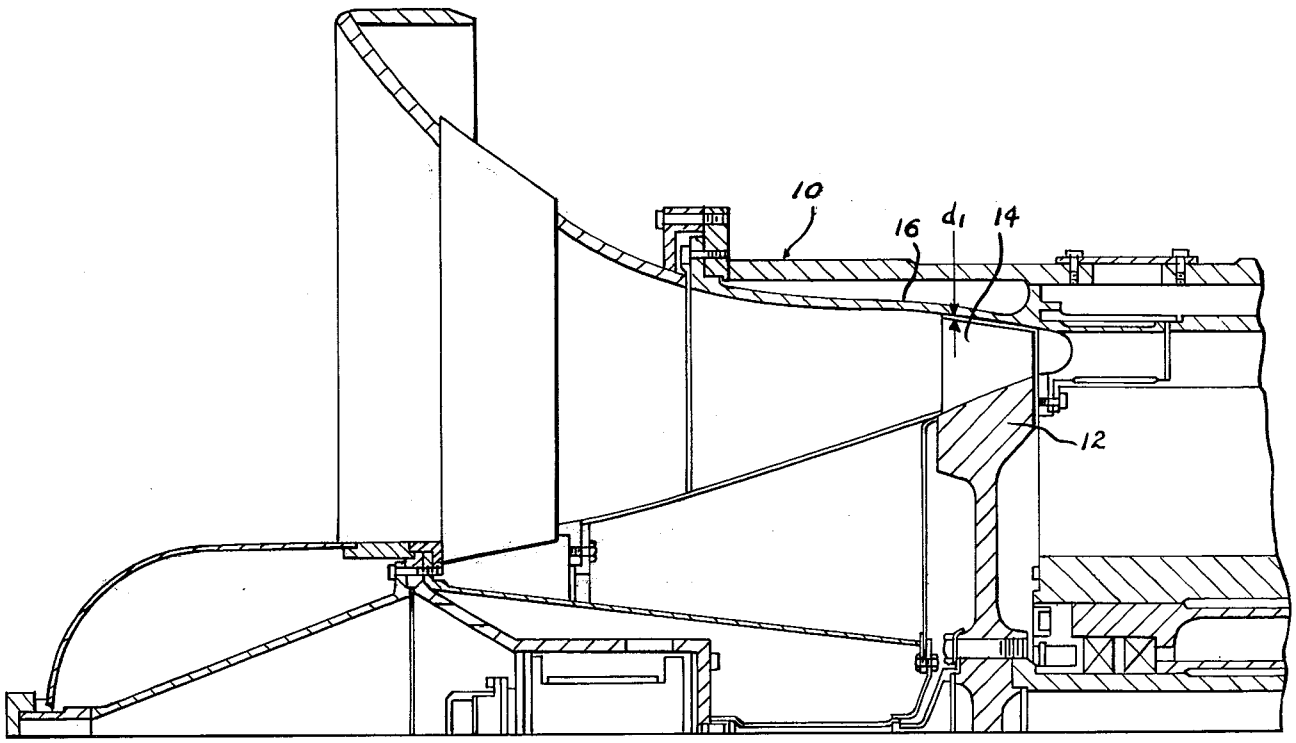
Fig-1 PRIOR ART
FIG. 1 is a partially schematic sectional view of an axial compressor.
Figure 2:
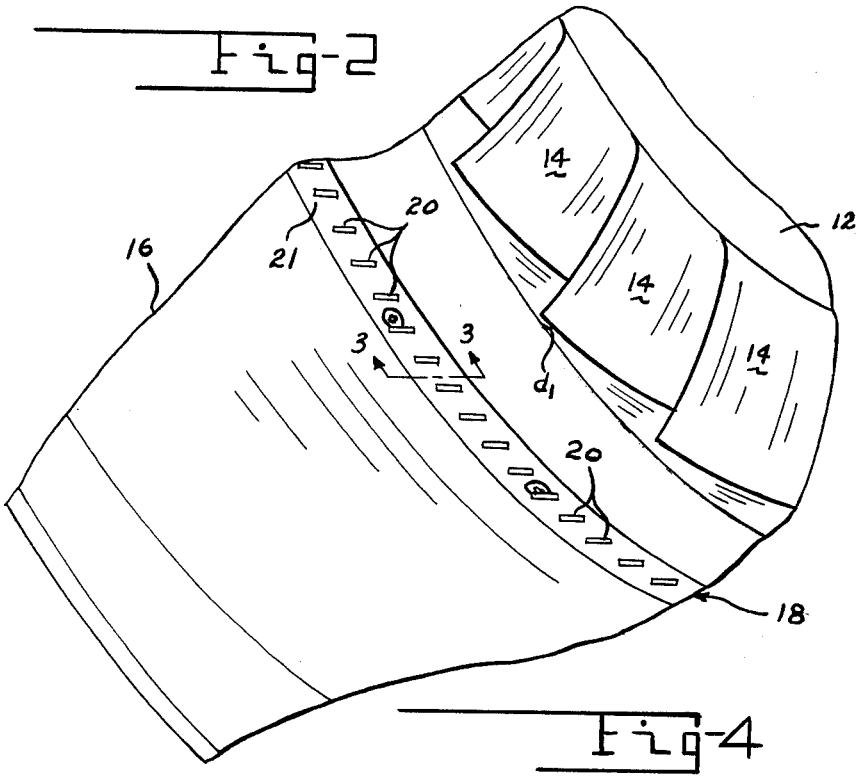
FIG. 2 is a partially schematic cut away isometric view of an axial flow compressor of FIG. 1 with the Vortex generator system of the invention.
Figure 4:
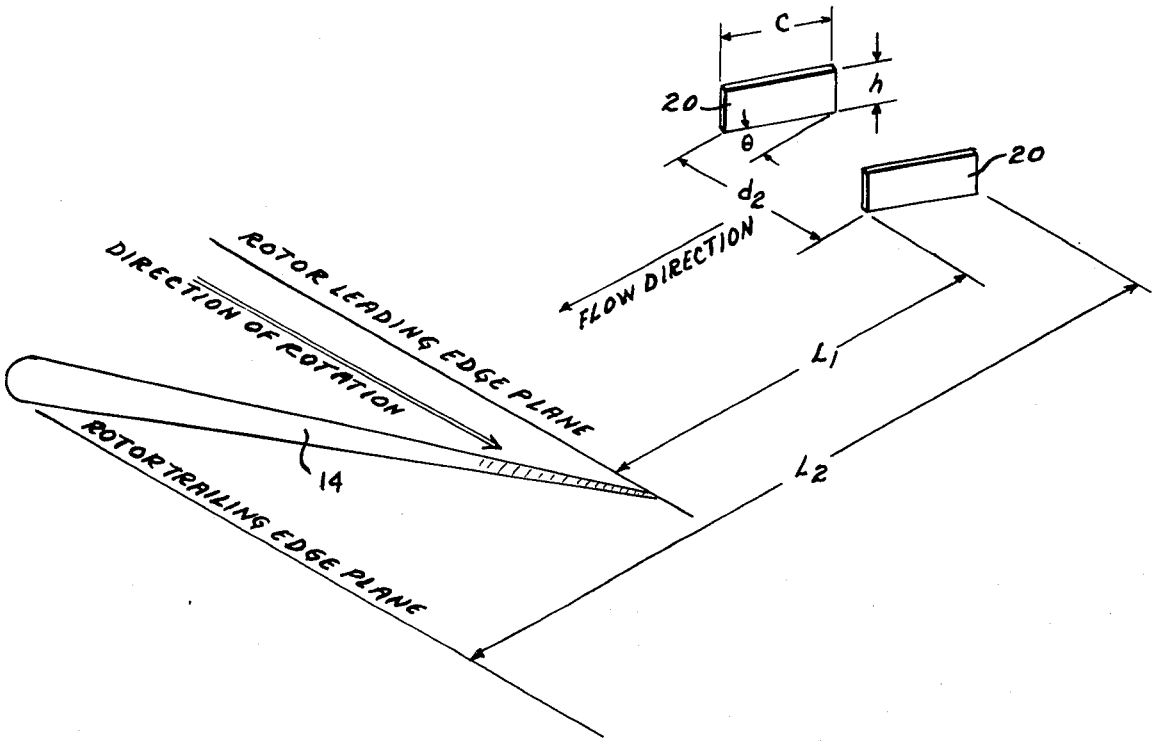
FIG. 4 is a schematic diagram showing relative dimensions between the vortex generator system and the rotor in the axial flow compressor of FIGS. 2 and 3.

Reference is now made to FIG. 1 of the drawing which shows an axial flow compressor 10 wherein the rotor 12 has blades 14 spaced from the casing 16 with a running clearance indicated at $d_1$. According to this invention, a vortex generator system 18 is positioned upstream of the rotor 12, as shown in FIGS. 2 and 3. The vortex generator system 18 is spaced a distance $L_1$ from the leading edge of rotor 12 with the trailing edge of the rotor being spaced a distance $L_2$ from the leading edge of the vortex generator system, as shown in FIG. 4. The vortex generator system has a plurality of blades 20 mounted on a support ring 21 with the distance between the blades being shown at $d_2$ in FIG. 4. The support ring 21 is positioned within an annular recess 22 in the casing wall 16. The inner surface of the ring 21 is flush with the inner surface of wall 16.

It has been found, when vortex generators are used in axial flow compressors, that if the vortex generator system is not properly designed and positioned with respect to the compressor dimensions, excessive losses will occur which in some cases may be greater than any benefit obtained from energization of the boundary layer. It has been found that the height, $h$, of the vortex generator blades should be greater than the running clearance $d$, but less than ten times the running clearance. It has also been found that the spacing between the vortex generator blades should be at least four times the height of the blades and less than ten times the height. The cord length C of the blade should be between $1h$ and $4h$.

When there are too few vortex generator blades as compared with rotor blades, the vortex generators do not just energize the boundary layer but also the vortex flow interacts with the flow field which results in excessive losses in the compressor. It was found that there should be at least three vortex generator blades for each rotor blade. Normally, there would never be more than ten vortex generator blades for each rotor blade.

It was found also that the vortex generators should produce co-rotating vortices. The direction of rotation of the vortices should be chosen such that the rotor circumferential pressure gradient acting on the vortices will cause them to deflect outward toward the casing. Thus, they should be pitched with respect to the rotor blades as shown in FIGS. 2 and 4.

The maximum benefit from the use of vortex generators, to increase the efficiency and stall margin, was found to occur in the region between 10 and 80 times the height of the vortex generators. Therefore, the distance $L_1$ should be greater than $10h$ and $L_2$ should be less than $80h$.

In one axial flow compressor design with a running clearance $d_1$ equal to 0.025 in, the blade height $h$ was 0.06 in, the spacing $d_2$ was 0.39 in, C was 0.25 in, the distance $L_1$ was 1.69 in, the distance $L_2$ was 3.94 in and the angle $\theta$ was 20°. There were 30 blades in the rotor and 144 blades in the vortex generator system.

The axial flow compressor operates in a conventional manner. The air flow over the vortex generator blades causes the blades to shed co-rotating vortices which are directed toward the rotor. The rotor circumferential pressure gradient acting on the vortices causes them to deflect outward toward the casing to energize the boundary layer.

There is thus provided a vortex generator system for an axial flow compressor which will provide greater efficiency than prior art systems.

I claim:

1. In a compressor having an axial flow passage within an outer casing wall and a rotor having a plurality of rotor blades within said passage with said rotor blades being spaced from said wall with a running clearance $d_1$; a vortex generator system within said flow passage, comprising: an annular channel in the casing wall upstream of said rotor; a support ring in said channel having its inner surface flush with the inner surface of the casing wall; means, supported on said support ring for producing at least three co-rotating vortices in front of each of said rotor blades with the vortices coacting with the rotor circumferential pressure to deflect the vortices outward toward the casing wall; said vortex generator system includes a plurality of vortex generator blades equal to at least three times the number of rotor blades for producing said co-rotating vortices; said vortex generator blades having a height h greater than $d_1$ and less than $10d_1$, with a spacing between the blades being greater than $3h$ and less than $10h$; said vortex generator system being spaced from said rotor blades a distance greater than $10h$ with the trailing edge of the rotor being a distance less than $80h$ from the leading edge of the vortex generator system.

* * * * *